United States Patent [19]

Leverte

[11] Patent Number: 4,823,245

[45] Date of Patent: Apr. 18, 1989

[54] MEANS FOR ADDING COLORS TO ELECTRIC LIGHTS

[75] Inventor: Robert Leverte, Elmont, N.Y.

[73] Assignee: The Douglas Leigh Organization, New York, N.Y.

[21] Appl. No.: 182,197

[22] Filed: Apr. 14, 1988

[51] Int. Cl.[4] ..... F21V 9/00

[52] U.S. Cl. ..... 362/293; 362/294; 362/319; 350/318

[58] Field of Search ..... 362/277, 293, 294, 319, 362/351; 350/311, 315, 318

[56] References Cited

U.S. PATENT DOCUMENTS

| | | | |
|---|---|---|---|
| 1,478,473 | 12/1923 | Herron | 362/277 |
| 2,297,974 | 10/1942 | Moore | 362/277 |
| 4,321,659 | 3/1982 | Wheeler | 362/293 |

*Primary Examiner*—Stephen F. Husar

[57] ABSTRACT

Apparatus for adding color to electric lights of the type having a bulb mounted in a hollow member, the hollow member having an open end. A frame is mounted over the open end. A translucent color sheet is removably mounted in the frame. A first clear sheet is mounted on one side of the color sheet, whereby the color may be changed by changing the color sheet.

2 Claims, 2 Drawing Sheets

10
LEXAN FILTER

8
GEL
LEXAN
10
5
LEXAN
9
5

9
LEXAN
8
COLOR GEL
LEXAN
10
FILTER FRAME
5

FILTER FRAME
5
6
4
7
SPACER
3
LIGHT
1
2

MEANS FOR ADDING COLORS TO ELECTRIC LIGHTS

TECHNICAL FIELD

This invention relates to means for adding colors to electric lights and more particularly, to spot lights and lights mounted on the exteriors of buildings.

BACKGROUND

Many buildings have external lighting, especially tall buildings, such as the Empire State Building and the buildings along Broadway, in New York City.

In this installation, it is desirable to change the color of the lights for various reasons, for instance, to celebrate certain occasions.

PRIOR ART

No pertinent prior art is known.

THE INVENTION

The invention comprises means for adding color to electric lights of the type having a bulb mounted in a hollow member, the hollow member having an open end comprising: a frame mounted over the open end, a translucent color sheet removably mounted in said frame, a first clear sheet mounted on one side of the color sheet, whereby the color may be changed by changing the color sheet.

OBJECTS OF THE INVENTION:

A principal object of the invention is to provide new and improved means for adding different colors to electric lights.

Another object of the invention is to provide means for adding different colors to spot lights and exterior building lights.

Another object of the invention is to provide new and improved means for adding color to electric lights of the type having a bulb mounted in a hollow member, the hollow member having an open end comprising: a frame mounted over the open end, a translucent color sheet removably mounted in said frame, a first clear sheet mounted on one side of the color sheet, whereby the color may be changed by changing the color sheet.

These and other objects of the invention will be apparent from the following specification and drawings.

BEST MODE OF THE INVENTION

Figures 1, 2, 3, 4, 5:
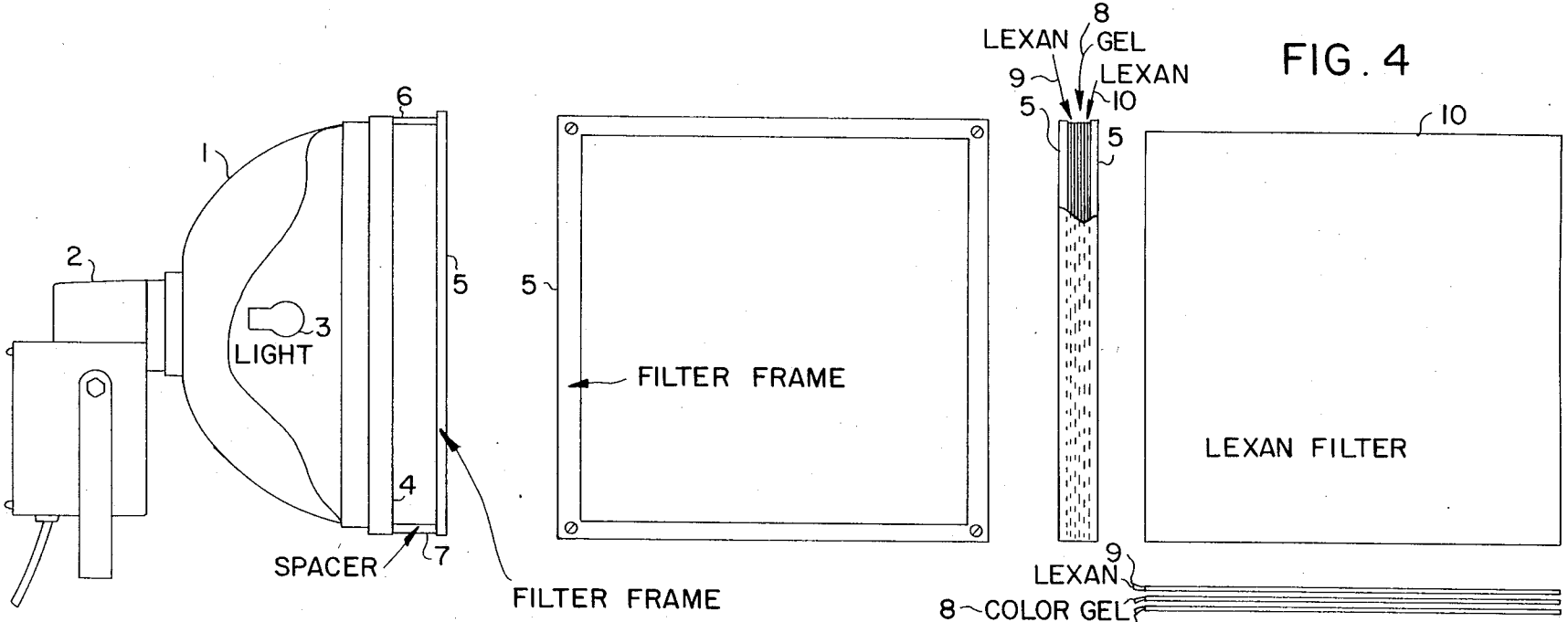
FIG. 1 is a side view of an embodiment of the invention.
FIG. 2 is a detail view of the frame member.
FIG. 3 is a detail side view showing the mounting of the color sheets.
FIG. 4 is a plan view of a protective clear sheet.
FIG. 5 is a bottom view of FIG. 4.

Referring to the drawings, the invention comprises a hollow member 1, which is mounted on a conventional bracket 2, bulb 3. The hollow member has an open end 4. A frame 5 is mounted around the open end by spacers 6 and 7.

FIGS. 2 to 5 show a frame assembly.

FIG. 2 shows a detail view of the frame 5.

FIG. 3 shows a translucent color sheet 8, which may be of Dupont deep dyed Mylar which is a translucent plastic.

The color sheet 8 is sandwiched between two clear sheets 9 and 10, which may be of Lexan material which is a clear plastic polycarbonate. This assembly is mounted in the frame 5.

Figure 6:
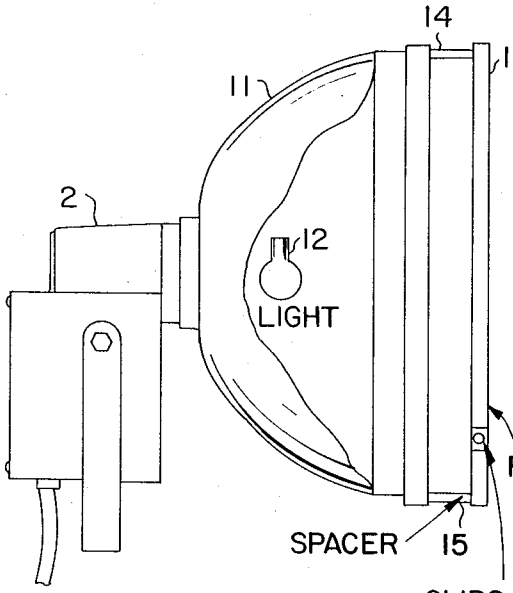
FIG. 6 is a side view of an electric light having a circular configuration.

FIG. 6 shows a similar hollow member 11 which has a circular configuration and has a white light bulb 12. The member 11, is mounted on a conventional bracket 19. A circular filter ring 13 is mounted on the hollow member 11, by means of spacers 14 and 15.

Figure 8:
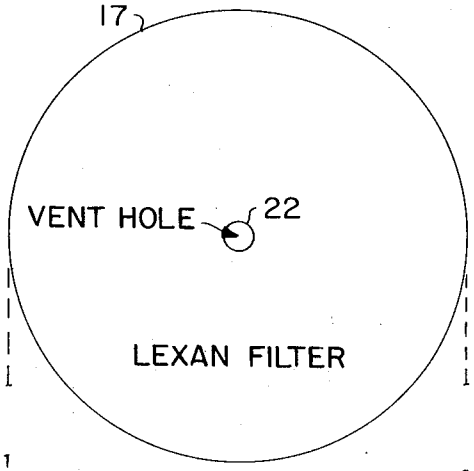
FIG. 8 is a detail view of one of the clear sheets for the embodiment of FIG. 6, having a vent to dissipate heat.
Figure 9:
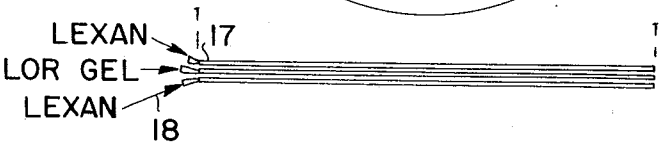
FIG. 9 is a side view of FIG. 8.
Figure 7:
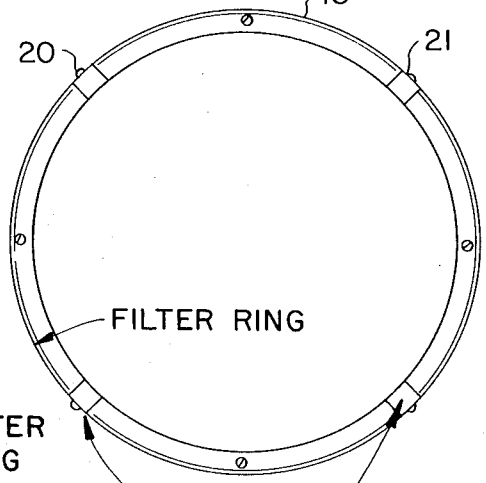
FIG. 7 is a detail view of the frame for the embodiment of FIG. 6.

Referring to FIGS. 7, 8 and 9, the color sheet 16 is sandwiched between two clear sheets, 17 and 18, which may be of Lexan material. The three sheet assembly is mounted in the filter ring 13 by means of clips, 20, 21, etc., Lexan is a polycarbonate.

Referring to FIG. 8 the clear Lexan sheets, 17 and 18, have a center aperture 22, for the purpose of dissipating heat from the bulb 12.

It is claimed:

1. Apparatus for adding color to electric lights of the type having a bulb mounted in a hollow member having an open end comprising:

a frame mounted over the open end, a translucent color sheet removably mounted in said frame a first clear sheet mounted on one side of the color sheet, a second clear sheet mounted on the other side of said color sheet whereby the color may be changed by changing the color sheet.

2. Apparatus for adding color to electric lights of the type having a bulb mounted in a hollow member having an open end comprising:

a frame mounted over the open end, a translucent color sheet removably mounted in said frame a first clear sheet mounted on one side of the color sheet, a second clear sheet mounted on the other side of said color sheet by changing the color sheet, wherein the open end of said member is circular and wherein the first and second clear sheets have a center aperture to dissipate heat.

* * * * *